US009464379B2

(12) United States Patent
Pedoja

(10) Patent No.: US 9,464,379 B2
(45) Date of Patent: Oct. 11, 2016

(54) PROCESS FOR PRODUCING WOVEN-NON-WOVEN PARTICULARLY SOFT, RESISTANT AND WITH A VALUABLE APPEARANCE

(71) Applicant: SUOMINEN CORPORATION, Helsinki (FI)

(72) Inventor: Roberto Pedoja, Cuasso al Monte (IT)

(73) Assignee: SUOMINEN CORPORATION, Helsinki (FI)

( * ) Notice: Subject to any disclaimer, the term of this patent is extended or adjusted under 35 U.S.C. 154(b) by 295 days.

(21) Appl. No.: 13/945,320

(22) Filed: Jul. 18, 2013

(65) Prior Publication Data

US 2013/0330516 A1 Dec. 12, 2013

Related U.S. Application Data

(62) Division of application No. 11/817,596, filed as application No. PCT/IT2005/000118 on Mar. 3, 2005, now Pat. No. 8,512,607.

(51) Int. Cl.

| | |
|---|---|
| ***D06J 1/10*** | (2006.01) |
| ***D04H 1/4258*** | (2012.01) |
| ***D04H 1/4374*** | (2012.01) |
| ***D04H 1/48*** | (2012.01) |
| ***D04H 1/485*** | (2012.01) |
| ***D04H 1/495*** | (2012.01) |

(Continued)

(52) U.S. Cl.

CPC ..... *D06J 1/10* (2013.01); *D04H 1/4258* (2013.01); *D04H 1/4374* (2013.01); *D04H 1/48* (2013.01); *D04H 1/485* (2013.01); *D04H 1/495* (2013.01); *D04H 1/498* (2013.01); *D04H 1/54* (2013.01); *D04H 3/16* (2013.01); *D04H 5/03* (2013.01); *D04H 5/06* (2013.01); *D04H 18/04* (2013.01); *Y10T 428/24479* (2015.01); *Y10T 442/60* (2015.04)

(58) Field of Classification Search

CPC ..... D04H 1/485; D01H 1/495; D06J 1/10

See application file for complete search history.

(56) References Cited

U.S. PATENT DOCUMENTS 4,407,879 A * 10/1983 Smart ..... B29C 59/18 264/280
5,334,446 A * 8/1994 Quantrille ..... D01G 25/00 428/109

(Continued)

FOREIGN PATENT DOCUMENTS

| | | |
|---|---|---|
| JP | 2003-520306 | 7/2003 |
| JP | 2004-500494 | 1/2004 |

(Continued)

OTHER PUBLICATIONS

International Search Report completed Nov. 24, 2005.

*Primary Examiner* — Timothy Kennedy

(74) *Attorney, Agent, or Firm* — Nixon & Vanderhye P.C.

(57) ABSTRACT

A manufacturing plant for non-woven web including: a hydro-embossing device and a thermo-embossing device for treating the non-woven web, a drive system for advancing the non-woven web along the hydro-embossing device and the thermo-embossing device system, and a control and command unit operatively connected to the hydro-embossing device and the thermo-embossing device, such that respective treatments are carried out on dedicated portions of the non-woven web.

14 Claims, 6 Drawing Sheets

(51) Int. Cl.

| | |
|---|---|
| ***D04H 1/498*** | (2012.01) |
| ***D04H 1/54*** | (2012.01) |
| ***D04H 3/16*** | (2006.01) |
| ***D04H 18/04*** | (2012.01) |
| ***D04H 5/03*** | (2012.01) |
| ***D04H 5/06*** | (2006.01) |

(56) References Cited

U.S. PATENT DOCUMENTS

| | | | |
|---|---|---|---|
| 5,587,225 | A | 12/1996 | Griesbach et al. |
| 6,321,425 | B1 | 11/2001 | Putnam et al. |
| 2001/0005926 | A1 | 7/2001 | Noelle |
| 2003/0024092 | A1 | 2/2003 | Orlandi |
| 2003/0106195 | A1 | 6/2003 | Fleissner |
| 2004/0116031 | A1 | 6/2004 | Brennan et al. |
| 2006/0016359 | A1* | 1/2006 | Ford ..... B41F 13/025 101/484 |

FOREIGN PATENT DOCUMENTS

| | | |
|---|---|---|
| JP | 2006-506543 | 2/2006 |
| RU | 2 068 864 | 11/1996 |
| RU | 2 387 746 | 4/2009 |
| SU | 1373741 | 2/1988 |
| WO | 00/64408 | 11/2000 |
| WO | WO 2004/092472 | 10/2004 |
| WO | WO 2005/012618 | 2/2005 |
| WO | WO 2005/059216 | 6/2005 |
| WO | WO 2005/075199 | 8/2005 |

* cited by examiner

PROCESS FOR PRODUCING WOVEN-NON-WOVEN PARTICULARLY SOFT, RESISTANT AND WITH A VALUABLE APPEARANCE

RELATED APPLICATIONS

This application is a divisional of U.S. application Ser. No. 11/817,596 filed Sep. 12, 2008, which is a U.S. national phase of International Application No. PCT/IT2005/00018 filed Mar. 3, 2005 which designated the U.S., wherein the entire contents of these applications are hereby incorporated by reference.

BACKGROUND

The present invention relates to a process and equipment for producing a non-woven fabric provided with optimum softness and resistance characteristics, as well as visually attractive. Particularly, the invention relates to a process and equipment for manufacturing non-woven fabrics of the spun-lace (hydro-entangled NWF) type and the non-woven fabrics obtained therefrom.

Non-woven fabric based products provided with various characteristics suitable for specific purposes have been known for a long time. For example, particularly soft non-woven fabric based products are known for use in the personal hygiene field, such as humidified towelettes. Other products are the non-woven fabrics, either dry or impregnated with substances of different nature, which are particularly resistant for use in the household cleaning field or on industrial scale.

The products currently available on the market differ from each other in the specific properties resulting from the various structures and workings being carried out in order to meet different usage requirements.

SUMMARY OF INVENTION

The technical problem at the heart of the present invention is to provide a process for manufacturing a non-woven fabric based product that is provided with optimum softness characteristics and, at the same time, optimum resistance characteristics for use both in the personal hygiene field and household cleaning field.

This problem is solved by means of a process for manufacturing non-woven fabric as claimed in the independent claim annexed below.

A further technical problem that has been solved by the present invention is to provide a process and plant for manufacturing non-woven fabrics such as those described above comprising signs and/or drawings printed thereon in a reliable and quick manner, such as to obtain a printing process ensuring cost-effective productivity.

This problem is solved by means of a process and manufacturing plant such as claimed in the annexed claims herein below.

SUMMARY OF THE DRAWINGS

Further characteristics and the advantages of the present invention will be better understood from the description below of some embodiments, which are given as non-limiting examples with reference to the figures in which.

DETAILED DESCRIPTION OF AN EMBODIMENT(S) OF THE INVENTION

Figure 1:
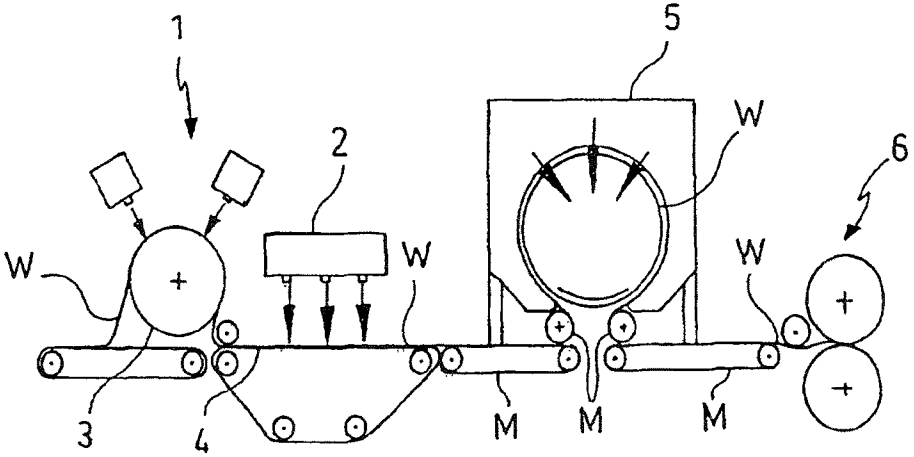
FIG. 1 is a schematic view of a manufacturing line for the non-woven fabric in accordance with the present invention.

Therefore, a first object of the present invention is to provide a process for manufacturing a non-woven fabric suitable to give softness/fluffiness as well as resistance characteristics to the same.

A second object is to provide an equipment for the production of a non-woven fabric provided with said characteristics.

A third object is to provide a non-woven fabric provided with said softness/fluffiness characteristics as well as resistance for use both as a product for personal hygiene and household cleaning purposes.

It has been surprisingly observed that in order to solve the technical problem mentioned above, a non-woven fabric can be subjected to a process comprising a hydro-embossing treatment and a thermo-embossing treatment, in other words the non-woven fabric is treated by means of embossing according to two different methods known in the field.

Particularly, the hydro-embossing treatment allows to obtain a product provided with optimum softness characteristics. Furthermore, the non-woven fabric treated by means of this technology at the same time allows the creation of drawings and/or signs also in relief with a visual effect of delicate shading, thereby creating a sensation of softness both to the eye and touch, and providing a sense of "depth" rather than "perspective". These tactile and visual characteristics are provided by means of an equipment comprising one or more stations consisting of a plurality of very fine nozzles delivering high pressurized water jets. Preferably, the nozzles are arranged such as to give origin to the desired signs or drawing.

Following said treatment, the non-woven web is worked such as to entangle to each other the fibres that make it up while leaving them free to move relative to each other in order to create the desired soft effect.

Thermo-embossing is different from the above treatment in that it allows to provide the non-woven fabric with resistance characteristics by carrying out binding points of the fibres which make it up. Particularly, the fibres are sealed to each other by heating and crushing such as to prevent that they may move relative to each other, thereby providing compactness and resistance.

Furthermore, the product can be enriched with signs or drawings also during this treatment. In fact, thermo-embossing is carried out using conventional thermo-embossing calendars where a non-woven web is passed through two opposed cylinders. Either one or both of said cylinders is heated and has an engraved surface, usually made of metal, such as to create the desired signs or drawing whereas the other is usually rotatably pressed against the embossed cylinder and provided with a rubber or metal surface. The result of this pressing and heating treatment is to form strong binding points between the fibres while at the same time obtaining marked and well defined signs or drawings.

The non-woven fabric subjected to the process of the invention can be of the spun-lace type, the material which makes it up being either carded or spunbonded.

The carded material may substantially consist only of natural or synthetic fibres (ranging between 0.9 and 7 denier) such as polyester, polypropylene, PLA, viscose, LYOCELL™, optionally in admixture with each other, or said fibres combined with cellulose pulp. Furthermore, regardless of the material used, the non-woven fabric may consist of one or more layers according to specific requirements or particular preferences. Preferably, the non-woven fabric consists of three layers, a cellulose pulp layer being sandwiched between two layers of synthetic or natural fiber. The product obtained is commonly called a multi-layer non-woven fabric, the various layers being placed one on top of the other according to a desired order and held together, i.e. consolidated, in accordance with fully conventional technologies. Preferably, consolidation is carried out by hydro-entanglement.

The spunbond material may substantially consist only of polymer fibres, such as polypropylene, polyester, PLA and LYOCELL™ ranging between 0.9 and 2.2 deniers, or also nanofibers (NANOVAL) and also bicomponent fibers combined with cellulose pulp such as described above. Also in this case, the deposition, multi-layer composition and consolidation can be carried out using techniques known in the field, hence they will not be illustrated herein below.

With reference to FIG. 1, the process in accordance with the invention as well as an exemplary equipment designed for carrying out said process will be described below.

The process for manufacturing non-woven fabric comprises two subsequent steps of variously treating a non-woven web by means of any process selected from hydro-embossing and thermo-embossing in any order.

In other words, the process can comprise a first hydro-embossing treatment step and a second thermo-embossing treatment step being carried out on a non-woven web, which may be either single-layer or multi-layer. Alternatively, the steps are reversed, i.e. thermo-embossing is the first treatment step and hydro-embossing is the second treatment step.

In FIG. 1, the hydro-embossing step is illustrated first, which is carried out using technologies known in the field as discussed above in at least one equipment 1, 2. For example, the hydro-embossing treatment may be carried out in a first equipment 1 where a non-woven web W is carried on a support roller 3, the hydro-embossing nozzles being arranged on the circumference thereof. Next, the non-woven fabric W is carried on a plane support 4 below a second hydro-embossing equipment 2 to be optionally subjected to further processing. Providing two equipments allows to achieve two different hydro-embossing effects (both with belt and roller).

Next, the wet non-woven fabric is carried to a fully conventional drier (iron) 5, such as a drum drier.

Now, the non-woven fabric W may either be wound on a roll and carried to a dedicated manufacturing line for the thermo-embossing treatment, or pass in-line, to the thermo-embossing step as represented in FIG. 1.

The thermo-embossing step provides that the non-woven fabric passes through, either on a suitable support or not, a conventional calender-embosser 6 where it is subjected to crushing and heating such as to cause the fibers to bind in preset locations, also in accordance with the signs and/or drawings to be provided.

The non-woven fabric thus obtained is advantageously provided with optimum softness and fluffiness properties, though being resistant to manipulation and wear. Particularly, the non-woven fabric is effectively suited for use both as a delicate aid for personal hygiene and resistant cloth for household or industrial cleaning.

Furthermore, the hydro-embossing and thermo-embossing treatments, as discussed above, can be carried out such as to combine said functional aspects with a noticeable attractive appearance and depth of visual field because the object being close to the human eye is simulated by the thermo-embossing treatment, the one far on the horizon being simulated by the hydro-embossing treatment. In fact, due to the combination of the above technologies, soft and shadowed three-dimensional drawings and/or signs can be obtained by hydro-embossing, while well marked and defined drawings and/or signs. The attractive appearance derives from the fact that a shadowed effect creating a background and a distinct effect creating a foreground are obtained.

It should be noted that with the process described above the soft and fluffy effect created by hydro-embossing overlap the resistant and bound effect resulting from thermo-embossing. In other words, the soft portions of the non-woven fabric have some bonded points, i.e. in these portions the non-woven fabric fibers have a relatively limited degree of freedom and movement. Consequently, though providing a good combination of desired technical characteristics, the resulting product has however a limited degree of softness.

In accordance with a variant embodiment of the inventive process, it has been studied a way to increase the softness of the non-woven fabric without altering the characteristics of resistance and bond in a substantial manner.

It has been surprisingly found that when the thermo-embossing treatment is carried out on those portions not involved by the hydro-embossing treatment, the non-woven fabric is considerably softer while at the same time strength and resistance are kept substantially unchanged.

To the purpose, the design of a particular process and equipment has been required.

The manufacturing process comprises a control and command system connected with the driven members and the devices of the treatment stations.

Particularly, the system comprises a control and command unit 7 (schematically represented in FIG. 6) connected with the hydro-embossing 1 and 2 and thermo-embossing 6 devices which has the function of commanding and controlling said devices in a separate manner. The control and command unit 7 is thus operatively connected with the mechanical and electronic components of said devices such as to create only one electric axis.

Therefore, in the inventive process, the above hydro-embossing and thermo-embossing treatment steps are advantageously subjected to the control and command of a control and command unit for said treatments to be carried out on dedicated portions of the non-woven fabric in accordance with a preset pattern. In other words, the unit will comprise a memory storing a working pattern for the non-woven fabric, according to which a program loaded on the control and command unit will give instructions through electric signals to control and command that the hydro-embossing treatment is carried out on preset portions other than those involved in the thermo-embossing treatment which has already been done or will be done. In practice, the second treatment will be guided such as to be carried out on the free portions of the non-woven fabric, i.e. those portions not involved in the first treatment. There results that both treatments are not carried out on one point, i.e. they do not overlap.

Furthermore, the process comprises treating said non-woven fabric, both single-layer and multilayer, with hydro-embossing technology such as to cover a surface thereof ranging from 5% to 95% of total. The remaining surface, i.e. 95% to 5%, is treated with thermo-embossing technology such as to involve 2 to 30% surface. In other words, the surface of non-woven fabric not involved in the hydro-embossing treatment is, in turn, treated with thermo-embossing with the percentage mentioned above (2-30%). Preferably, the total surface of the non-woven fabric treated with hydro-embossing accounts for about 50% of the total surface of the non-woven fabric, the remaining 50% being about 10% treated with thermo-embossing. In case of print, the part ranging between 5 to 95% may have 2-100% coverage.

In addition, the control and command unit can be also connected to all motors of the driving members 3, 4, M that arranged all along the manufacturing line. The driving members will not be described herein because they are fully conventional and usually comprise the supports of the non-woven fabric, usually in the form of belts driven by rotating rolls or rotating drums, as well as the rotating members located at the entrance and exit of each treatment equipment.

Particularly, the control and command unit is capable of detecting electrical signals originating from said members, turn said signals into numerical values representative of the status of their angular speed and torque moment, comparing said numerical values with ratios of pre-established numerical values for said angular speed and said torques and sending signals to said members in order to correct any possible variations in said values which fall outside said ratios.

In fact, it is known that being the non-woven fabric a soft, stretchable material, it is easily creased mainly when passing through the hydro-embossing station, the drier and the thermo-embossing calender. Under these circumstances, the fibers which make it up are subjected to elongation or stretching in the longitudinal direction relative to the length of the non-woven fabric, and by way of reaction, they shrink in the width direction of the non-woven fabric. Between a station and the subsequent one, the non-woven fabric instead tends to return to the relaxed condition or even to form creases, precisely in response to being released from the tensioning to which its fibers have been subjected, thereby causing variations in thickness and weight and degrading the mechanical characteristics (CD/MD strength and elongations).

The formation of creases does not allow the attainment of a substantially flat surface onto which a suitable treatment may be carried out.

Consequently, the control and command system as described above allows to avoid said drawbacks and obtain the "area" of non-woven fabric destined to the second treatment in the proper position.

In other words, the control unit receives the electric signals that are turned into parameters indicating for example the angular speed of the rotating members and the torque (torque moment). To this end, the angular speeds of the members are then compared with one another and referred to preset values that are fixed for each different member and non-woven fabric product as a function of its inherent characteristics (weight, resistance, elongations). In particular, said preset values are calculated such as to set their ratios defined according to the physical characteristics of the non-woven-fabric, i.e. according to the typology of the non-woven-fabric, as illustrated in the introductory section of the present description. Accordingly, the driving system of all the rotating members must be coordinated such that the feeding of the non-woven fabric within the equipment does not cause the above mentioned creasing effects. Thus, the control and command unit sends electrical signals to the above motors so as to correct any possible variations in the preset angular speed values when they fall outside the defined ratios. In other words, the control and command unit constantly controls the individual angular speeds of the rotating members recording any variations which may occur following any inconsistency in the physical characteristics of the non-woven web, i.e. for example any variations in thickness, weight and humidity. These variations may cause elongation of the fibres of the non-woven web between one station and the subsequent one. Consequently, the treatment may result altered. Hence, the control and command unit acts on the angular speeds of the rotating members just to balance out any possible elongation effects. This adjustment is very important mainly considering that the hydro-embossing and thermo-embossing treatment processes are carried out continuously and in line with the production of the non-woven fabric (at high speeds, even higher than 400 m/min).

Figure 2:
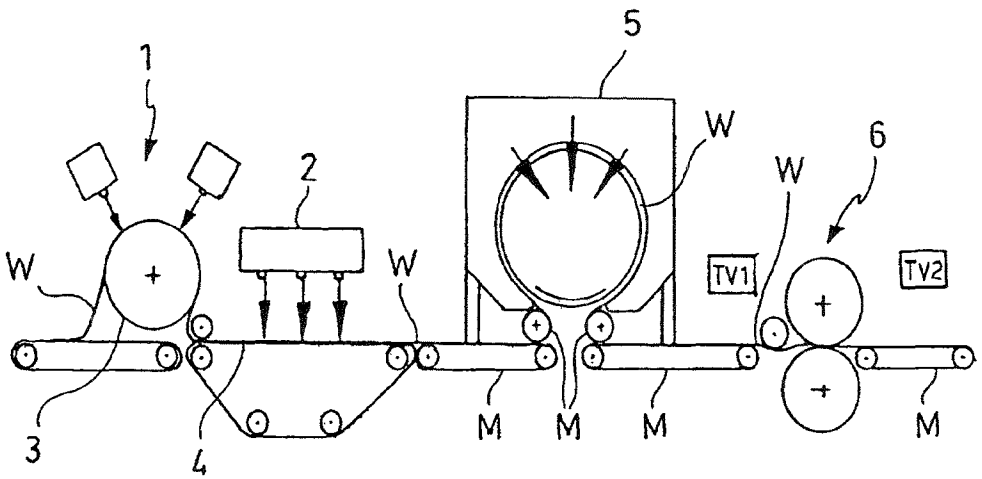
FIG. 2 is a schematic view of the manufacturing line from FIG. 1 in accordance with a first variant embodiment.

With reference to FIG. 2, there is schematically illustrated a manufacturing line substantially similar to the manufacturing line described with reference to FIG. 1, whereby the reference numbers in common designate identical stations or equipments.

A further control, which can be carried out in the inventive process, is carried out electronically (through closed-loop automatic control) with a continuous correction system for the couple torque and angular speed of the driving members. Particularly, the closed loop is made by using a colour video camera system as a transducer which keeps fixed "markers" made during the treatments, under control, and intervenes in the case of ratios/distances different from those set and stored. In other words, the closed-loop control comprises at least one image capturing device TV1, TV2, represented diagrammatically in FIG. 2, which is operatively connected to the control and command unit and suitable to constantly control the sheet of non-woven-fabric in order to detect the presence of any creases or variations in the hydro-embossing or thermo-embossing treatment pattern with respect to a preset standard.

The image capturing device TV1 may be for example a camera or a video camera. A colour digital video camera is particularly preferred, which is capable of filming a portion of NWF, for example while being output from an equipment. The image captured by the video camera is sent to the control and command unit in the form of electrical signals that are converted by said unit into digital data. These digital data are compared with standard data stored in the memory of the control and command unit and representative for example of a sign or drawing which must be reproduced on the NWF in a determined position. A suitable program loaded in said control and command unit will run the comparison operation of the aforesaid data and in the case where it would detect any differences, then it will send electrical signals to the various treatment or driving members with the aim of modifying, for example, their angular speed in order to correct the error. Alternatively, or simultaneously, the presence of creases along the NWF may be detected by said video camera and corrected in an entirely similar way to that explained previously.

In addition, the system may comprise a plurality of sensors S1, S2, S3, S4 positioned along the manufacturing line, having the function of detecting the presence of a stretching effect in well determined locations on the non-woven fabric sheet. The stretching effect is a condition in which the non-woven fabric sheet is kept tensioned, i.e. stretched, without causing fiber elongation, such as to prevent the formation of creases while the non-woven fabric is being treated and conveyed, as well as any shrinkage of the same.

The stretching sensors S1, S2, S3, S4 are devices, known per se, which send signals to the control and command unit about the tensioning state of the non-woven web and said unit will, in turn, act on the driving members to adjust variations in the stretching effect (or tensioning) in the same manner as discussed above, i.e. by adjusting their angular speed and/or torque moment.

The alignment control is a still further control that may be comprised in the process. This control consists in maintaining the signs and/or drawings aligned relative to the width of the non-woven web by means of a central sensor C and lateral sensors L. The lateral sensors L (illustrated in FIG. 3B) are positioned along the edges E of supports M of the non-woven fabric whereas the central sensor C is positioned either above or below the supports and in the middle relative to the width of the non-woven fabric. The sensors allow to constantly measure the distance between the middle line longitudinally dividing the non-woven fabric and the lateral edges such as to detect any variation and send signals to the control unit so that a correction system of the web positioning may intervene. The correction system is embodied by devices (not shown) that are known in the field, and therefore they will not be described below.

In accordance with a first variant embodiment of the invention, the process for manufacturing non-woven fabric such as described above can comprise a printing step comprising:

providing a printing equipment 8 for non-woven-fabric W comprising a driven support 9 for carrying said non-woven-fabric and at least one driven printing member 10;

feeding said equipment with said non-woven fabric sheet;

performing the printing on said non-woven fabric under the control and command of the above control and command unit 7, wherein said control and command unit is operatively connected with said support and at least one printing member such as to detect electrical signals originating from said support and at least one printing member, turning said signals into numerical values representative of the status of their angular speed and torque moment, comparing said numerical values with ratios of preset numerical values of said angular speeds and said torque moments and sending signals to said support and at least one printing member in order to correct any possible variations of said values which fall outside said ratios.

Both the printing equipment and the corresponding printing process advantageously correspond to those described in the international patent application PCT/IT2004/000127 of the same applicant, which is incorporated herein by reference.

Preferably, the process comprises a step wherein the motors which operate the rotating members of the equipment are separately controlled electronically by a control and command unit such as to make reference to the same electrical axis.

Particularly, said control, in order to have the same reference electric axis for all the motors of the rotating members, refers to what has been explained above concerning the control and command of the hydro-embossing and thermo-embossing treatments.

Still more preferably, the control performed by the control and command unit can be implemented thanks to an additional automatic closed-loop control comprising the aid of a video camera TV3 (FIG. 3) similar to that described above, and substantially having the same function as explained in the international patent application PCT/IT2004/000127.

The process may also advantageously include an operating step of holding means 11 in order to hold the non-woven fabric sheet onto the outer surface of the support, such as described in said international patent application.

The operating step of the holding means may be carried out using suction fans that are detailed in said international patent application, which by sucking air from outside the support 9, or press roller (shown in FIG. 3-5) through the through holes (not shown) made in the circumferential band thereof, hold the non-woven-fabric in position with the aim of ensuring the correct execution of the printing (print ratio between different dyes/shapes).

Preferably, the process of the invention also comprises a control step of the operating motor for the suction fans by said control and command unit, such as to be able to vary the suction force according to the typology of non-woven fabric being supported and conveyed by the press roller 9. Indeed, for example, if the non-woven fabric is a multilayer one, then it will be necessary to increase the suction force with respect to a single-layer non-woven fabric.

Furthermore, the process may comprise a step of separating the water from the air sucked by the suction fans. Said separation step is preferably carried out by means of separators (not shown) such as those described in the above patent application.

The printing step is carried out through flexographic (ink) or serigraphic (coloured paste) methods, which are conventional and hence will not be described herein in any further detail. It should be noted, however, that the process and equipment of the invention allow to print signs and/or drawings/figures in as many colours as there are engraved rollers arranged about the roller press 9. Preferably, the printing may be carried out with 2-12 dyes and the process can consequently include a dye management step.

Furthermore, the process comprises treating said non-woven fabric with hydro-embossing technology such as to cover a surface thereof ranging from 5% to 95% of total. The remaining surface, i.e. 95% to 5%, is treated with thermo-embossing technology such as to involve a surface ranging from 2 to 30%. Furthermore, the surface not involved in the two treatments can be printed involving 2-100% of the surface.

A further object of the present invention is to provide a plant for the production of non-woven fabrics (spun-lace, spunbonded, mechanically needled, needled and coated) directly on a treatment line such as that explained above.

Figure 3A:
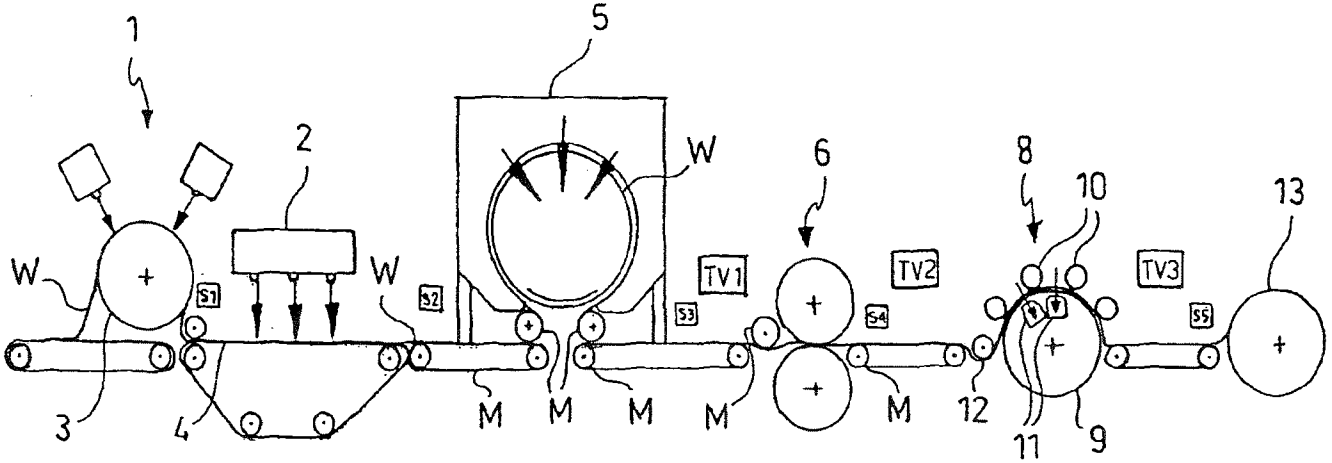
FIG. 3A is a schematic view of the manufacturing line from FIG. 1 in accordance with a second variant embodiment.
Figure 3B:
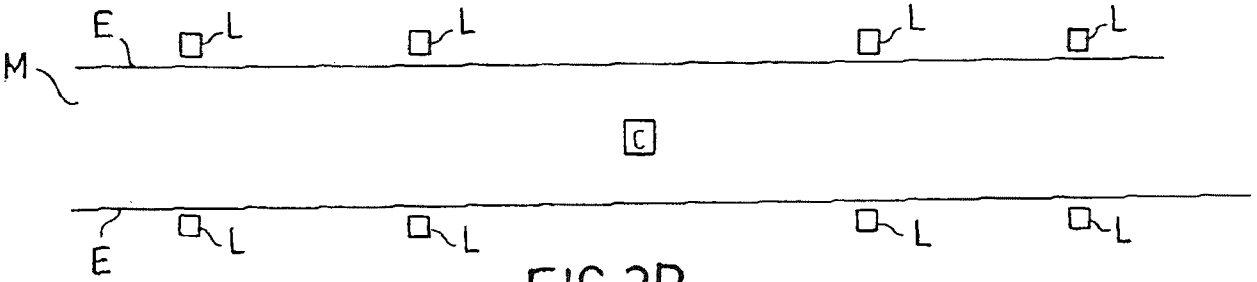
FIG. 3B is a top schematic view of a support portion of the non-woven fabric with alignment sensors.
Figure 4:
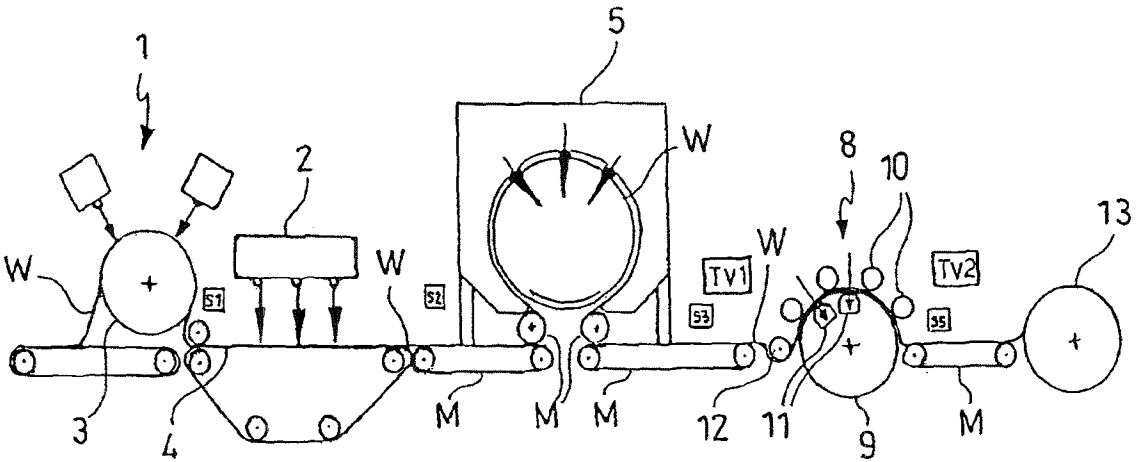
FIG. 4 is a schematic view of the manufacturing line from FIG. 1 in accordance with a third variant embodiment.

In FIG. 3 there is represented a plant consisting of a set of equipments arranged along the same manufacturing line comprising at least one hydro-embossing equipment 1, 2 and one thermo-embossing equipment 6 for treating a non-woven fabric W and a control and command unit 7 (FIG. 6) that is operatively connected with mechanical and electronic components of each of said hydro-embossing and thermo-embossing equipments such that the respective treatments are carried out on dedicated portions of the non-woven fabric.

Particularly, the control and command unit 7 corresponds to that described above with reference to the treatment process, whereby it will not be explained further herein.

Figure 6:
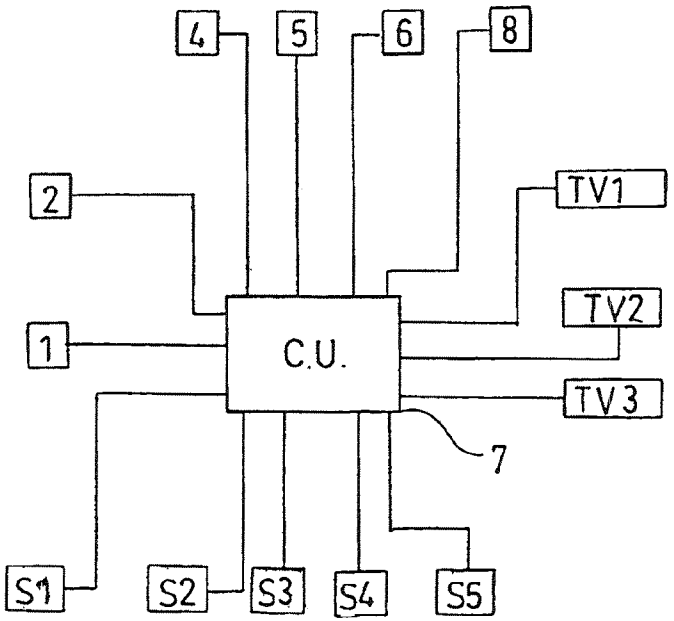
FIG. 6 is a block diagram of a control and command unit for a manufacturing line in accordance with the invention.

Furthermore, as discussed above, the control and command unit 7 can be connected to all the motors of the driving members 4, M that are positioned along the manufacturing line through electric lines, such as illustrated in FIG. 6.

In addition, the plant can comprise a video camera system TV1, TV2 as the transducer, such as described above, in order to obtain further control of the manufacturing process through a continuous and closed loop automatic correction system.

The plant can be further provided with a plurality of sensors S1-S4 that are arranged along the manufacturing line in order to detect the constant presence of the above stretching effect.

Advantageously, the plant can be also provided with alignment-control devices comprising said central C and lateral L sensors, as discussed above.

In accordance with a variant embodiment of the invention, the plant can comprise an equipment 8 for printing on non-woven fabric such as described in the international patent application PCT/IT2004/000127.

Particularly, this equipment corresponds to known printing machines to which there have been carried out innovative adaptations in order to obtain high-quality and high-speed printing. These adaptations consist in particular modifications carried out on flexographic machines which are known per se in the field, such as the flexographic printing machine F80 available from FOCUS/FUTURA or the flexographic machine 906 FAST 2 model 160/3500 sold by FLEXOTECNICA or similar machines. Preferably, auxiliary machines may be associated with this type of machine, such as a F70 unwinder, a F90A winder, a F401 loader, a F11A tube machine, a F30A cut-off machine, a F12 unwinder for tube machine sold by FOCUS/FUTURA.

Overall, the modifications are substantially represented by:

individually motorising each rotating member, i.e. input/output conveyor rollers for the product, press roller and engraved rollers;

providing a control and command unit in order to mutually command and control the angular speeds of said rotating members;

optionally providing a closed loop control system with video camera;

optionally modifying the press roller so as to provide it with suction holes;

optionally positioning suction fans inside the press roller flush with said holes and at the nip of the various engraved rollers;

optionally feeding hot air between the individual print rollers in order to dry the dye;

optionally providing pumps with water separators if printing on wet non-woven fabric is desired;

optionally providing input rollers with the function of mechanical wideners.

A printing equipment for non-woven fabric generally comprises a press roller 9, also called the support roller, at least one engraved roller 10 or printing member, means for holding 11 the non-woven sheet on the support, a water separator (not shown), a control and command unit 7 and guide means 12 suitable to guide and support a sheet of non-woven fabric to and from said equipment (only those being input are shown in FIG. 3).

Particularly, the press roller is represented by a conventional roller in which, however, there have been drilled through holes (not shown) all along the circumferential band thereof. These through holes allow communication between the outer surface of the circumferential band and the interior of the press roller.

Furthermore, at least one rotary driven engraved roller 10 is arranged about said press roller. Preferably, said at least one engraved roller consists of a plurality of rotating engraved rollers having the function of printing signs, dyes and/or drawings on the material being supported by the press roller. Particularly, each engraved roller may be driven by an independent motor.

Inside the press roller and at the nip of two rotating engraved rollers there are provided the driven holding means 11 preferably embodied by suction fans having the function of sucking hot air forced over the outer surface of the circumferential band of the press roller, said means being conventional dye drying equipments. The suction fans may be, for example, simple, entirely conventional fans driven by a motor, itself also entirely conventional, such as to suck air from the outside of the press roller towards the inside thereof through the through holes. Alternatively, said suction fans are pumps of the compressor or vacuum pump types.

The function of the suction fans and the through holes made in the circumferential band of the press roller is that of keeping the non-woven-fabric support firmly anchored onto the press roller in order to ensure that, on the one hand, said support does not move while being conveyed along the printing path and on the other hand counteract the formation of said creases.

Preferably, said suction fans are connected with an entirely conventional water separator (not shown), in the event that the non-woven fabric to be printed is wet. Indeed, in this case, the sucked air is loaded with humidity and in order not to release such humidity into the surrounding environment or directly onto any of the mechanical parts, the equipment may be provided with one or more water separators connected to each suction fan. Particularly, the water separators may be, for example, conventional condensers wherein a fluid is firstly compressed by a compressor and then allowed to expand within a path (coil) to be cooled down. The air sucked in by the suction fans 4 is directed onto the cold surface of the coil, such that the contact with a colder surface causes the water contained therein to be released in the form of condensation. Alternatively, the separation of the water occurs merely by mechanical and physical action (centrifugal force and different specific gravity) within a conventional coclea-shaped distillator screw operating according to the principle of a coil still.

The guide means 12 are embodied by driven rollers. In particular, said guide means are individually and independently motor-driven.

A roller 12 can be positioned near the press roller at the non-woven fabric T inlet to the printing stations. Said means are mechanical widening means, i.e. they allow increasing the height of the product and avoiding the formation of creases on the NWF support in the longitudinal direction relative to the length thereof. In other words, the NWF, when subjected to stretching in the longitudinal direction relative to its length, undergoes a shortening of its height (width). The widening means in question have therefore the function of restoring the original height of the NWF support.

Rollers can be positioned upstream of the equipment, i.e. at the end of the printing process in order to properly manage (stretch control) the NWF until a subsequent machine, if present, whether that be a drying oven (in the case of wet printing) or a winder (in the case of dry printing).

Advantageously, the equipment is connected to the above control and command unit 7, illustrated in FIG. 6, having the function of independently controlling and commanding the movement of all rotating members, as well as the suction fans and optional pump.

In particular, the control and command unit 7 is directly operatively connected to all mechanical and/or electronic components of the equipment such as to create a single electrical axis for all the components. Said control and command unit is indeed arranged such as to detect electrical signals originating from all the rotating members, turn said signals into numerical values representative of the status of their angular speed and torque moment, comparing said numerical values with ratios of preset numerical values for said angular speed and said torques and sending signals to said rotating members in order to correct any possible variations in said values which fall outside said ratios.

Particularly, the control and command unit is directly and independently connected to the motor of the press roller, each motor of the engraved rollers, each motor of the guide rollers as well as the motor of the suction fans and the motor of the optional water separator. Next, the electric signals are turned into parameters indicating for example the angular speed of the rotating members and the torque (torque moment). To this end, the angular speeds of the members are then compared with one another and referred to preset values that are fixed for each different member and product as a function of its inherent characteristics (weight, resistance, elongations). In particular, said preset values are calculated such as to set their ratios defined according to the physical characteristics of the non-woven fabric or, in other words, according to the typology of the non-woven-fabric, as illustrated in the introductory section of the present description. Accordingly, the driving system and all the rotating members must be coordinated such that the feeding of the non-woven fabric within the equipment does not cause the above mentioned creasing effects. Thus, the control and command unit 7 sends electrical signals to the aforesaid motors so as to correct any possible variations in said preset angular speed values when they fall outside the defined ratios. In other words, the control and command unit 7 constantly controls the individual angular speeds of the rotating members recording any variations which may occur following any inconsistency in the physical characteristics of the non-woven-fabric sheet, i.e. for example, any variations in thickness, weight or humidity. These variations may cause elongation of the fibres of the non-woven web between one printing station and the subsequent one. Consequently, the print may be altered. Hence, the control and command unit 7 acts on the angular speeds of the rotating members themselves in order to balance out any possible stretching effects. For example, if a section of the non-woven fabric support arrives at the first printing station having a greater thickness than the preceding portion already subjected to the first printing process, then its passage through the press roller and the first engraved roller will be slower and the fibres will be subjected to crushing and stretching with respect to the preceding portion. The resulting print may hence not be correctly synchronised with that preceding it. At this point, the angular speed of the roller press, the engraved rollers which follow said portion as well as all the other rotating members will have to be re-equilibrated so as to maintain the aforesaid preset ratio. This adjustment is very important, mainly considering that the printing process is carried out continuously and in line with the production of the non-woven-fabric (up to high speeds>300 m/min).

Furthermore, it should be noted that the control and command unit 7 also receives electric signals from the suction fans and water separator. Thereby, the transport of the non-woven fabric through the various printing stations, i.e. the engraved rollers, can be finely adjusted while holding the non-woven fabric support well anchored to the support embodied by the press roller. Furthermore, the suction and any possible condensation of water can be calibrated according to the typology of non-woven fabric thus constantly maintaining optimal printing conditions.

Additionally, the control and command unit may also act on the control of the dyes deposited by the engraved rollers by controlling flow, pressure and viscosity.

From what has been described thus far, it should be understood that the equipment for printing on non-woven fabric allows on the one hand to hold the material support well anchored onto the press roller by means of the suction system, and on the other hand avoids any undesired elongation of the fibres thanks to the arrangement of the control and command unit on the individual motors of the rotating members in order to have the same electrical axis, and in part also thanks to said suction system.

Further control is carried out electronically (through closed loop automatic control), the same as described above, with a continuous correction system for the torque and angular speed of the print rollers. Particularly, the closed loop is made by using a colour video camera system TV3 as a transducer which keeps fixed "markers" made during the printing process under control, and intervenes in the case of ratios/distances different from those set and stored.

The image capturing device 7 may be for example a camera or a video camera. A colour digital video camera capable of filming a portion of NWF, for example while being output from a printing station is particularly preferred. The image captured by the video camera is sent to the control and command unit 7 in the form of electrical signals and converted by said unit into digital data. These digital data are compared with standard data stored in the memory of the control and command unit 7 and representative for example of a sign or drawing which has to be reproduced on the NWF. A suitable program loaded in said control and command unit will run the comparison operation of the aforesaid data and in the case where it would detect any differences, then it will send electrical signals to the various printing members with the aim of modifying, for example, their angular speed in order to correct the error. Alternatively, or simultaneously, the presence of creases along the NWF may be detected by said video camera and corrected in an entirely similar way to that explained above.

In addition, the printing equipment may comprise a stretching sensor S5 positioned at the end of the printing process and before a winding roller 13, such as represented in FIG. 3. Said sensor corresponds to the stretching sensors described above, and cooperates with them for controlling the stretching or tensioning effect.

The non-woven-fabric which may be subjected to the printing process of the invention preferably consists of the fibres listed in the introductory section of the present description, either individually or in mixed products or three-layered products with cellulose pulp, or "fluff pulp" therebetween, or in two fibre/fluff pulp layers.

Particularly, if the non-woven fabric is formed in accordance with the carded spun-lace method, then it has grammage characteristics ranging between 30 and 250 g/m$^2$ and fibre lengths ranging between 1 mm and 70 mm (short mono- and bi-component fibres) and fluff pulp with <2.5 mm length following mechanical "opening".

Alternatively, if it is formed in accordance with the spunlace spun-bonded method, then it has a grammage ranging between 10 and 100 g/m$^2$ and continuous fibres, both for the single-layer and three layered product (two of spun-bonded with pulp therebetween).

At this point, the non-woven-fabric thus obtained in the form of a single web may be directly subjected to the printing process according to the invention, or may be first further processed in order to obtain a composite material.

Normally, non-woven fabric composite materials are sandwich-like structures comprising two outer layers obtained with the spun-lace or spun-bonded method, a cellulose or cellulose derivative pulp layer, subsequently hydro-entangled, being generally interposed therebetween.

The production of composite non-woven fabric normally provides the deposition of a first layer of non-woven-fabric on a suitable support, deposition of cellulose pulp on said first layer, deposition of a second layer of non-woven-fabric, consolidation by hydro-entanglement and final drying. Preferably, following the deposition of the first layer of non-woven fabric, a pre hydro-entanglement step may be carried out which is followed by drying.

From what has been described above, the process and equipment in accordance with the invention allow to obtain a non-woven fabric with particularly advantageous properties of softness and/or resistance as well as valuable aesthetic characteristics. Furthermore, the final product may be enriched with multicolour print that is carried out with extremely high precision and surprising production speed.

The non-woven fabric, in fact, can be produced with heights up to 6000 mm, preferably heights ranging between 30 and 6000 mm, still more preferably ranging between 100 and 6000 mm (preferred heights are 1650 or 3300 mm).

The continuous printing speed can exceed 400 m/min up to about 700 m/min, preferably ranging between 20 m/min and 300 m/min.

The NWF may be printed (1 to 12 colours) over only a small % age with respect to its surface (2-3%) up to a desired coverage of its surface, depending on the use of the NWF itself, i.e.: personal hygiene, household cleaning, matting, non-woven fabric for clothing, tablecloths, handkerchiefs, curtains (furnishings), bags, containers for items.

The characteristics just described allow operating under absolutely advantageous manufacturing conditions with respect to the technologies and the equipment of the prior art, and can be carried out directly on a spun-lace production line besides obviously on a suitable off-line machine.

Furthermore, the aforesaid adjustments of the control and command unit avoid the problems associated with the formation of creases as well as the danger of tearing the non-woven-fabric backing despite maintaining high printing speed.

Obviously, those skilled in the art, with the aim of satisfying contingent and specific requirements, can carry out a number of modifications and variations both to the equipment and the process for printing on non-woven fabric, all being however contemplated within the scope of the invention such as defined by the following claims.

For example, the machine dynamics control program can be stored on suitable electronic recipes that can be controlled through an electrical axis, electronic control of the dyes and closed loop video camera.

In accordance with another object of the invention, there is provided a process for manufacturing non-woven fabric that is printed with signs and/or drawings and provided with particular softness or resistance.

The process comprises a step of treating a non-woven web by means of hydro-embossing (FIG. 4) or thermo-embossing (FIG. 5) and a subsequent printing step, wherein the printing step comprises:

providing an equipment for printing on non-woven fabric comprising a driven support for carrying said non-woven fabric and at least one driven printing member;

feeding said equipment with said non-woven fabric sheet;

carrying out the printing (1 to 12 colours) on said non-woven fabric under the control and command of the control and command unit described above wherein said control and command unit is operatively connected with said support and at least one printing member such as to detect electrical signals from said support and at least one printing member, turning said signals into numerical values representative of the status of their angular speed and torque moment, comparing said numerical values with ratios of preset numerical values of said angular speeds and said torque moments and sending signals to said support and at least one printing member in order to correct any possible variations of said values which fall outside said ratios.

Preferably, the control and command unit acts separately and independently on each motor which operates the corresponding rotating member of the equipment such as to make reference to the same electrical axis.

Furthermore, the control unit can control that the printing step is carried out on dedicated portions other than the portions on which the hydro-embossing or thermo-embossing treatments are carried out. In other words, as discussed above with reference to the fact that the hydro-embossing and thermo-embossing treatments do not overlap, the printing is controlled also in this case such as to be carried out in portions not involved by said treatments such that overlapping is avoided.

The control by the control and command unit can also be implemented by an additional automatic closed-loop control, as described above, comprising the aid of an image capturing device.

The process can further comprise an operating step of the holding means, such as described above to hold the non-woven fabric sheet onto the outer surface of the support. The operating step of the holding means is achieved by suction fans which, by sucking air from the outside towards the inside of the support through the through holes, hold the non-woven-fabric onto said support.

The process also comprises a control step of the holding means operation by said control and command unit, such as described above.

In addition, a separation step of the water from the air sucked by the suction fans may be provided.

The printing step (1 to 12 colours) is carried out through flexographic (ink) or serigraphic (colour paste) methods known in the field and preferably comprises a dye management step carried out by the control and command unit through the optimisation of the characteristics of each dye, such as flow, pressure and viscosity, depending on the type of non-woven fabric to be printed. Furthermore, this step will be carried out precisely as described above.

A widening step may be further arranged in order to ensure that the height of the product will be maintained unchanged.

The hydro-embossing and thermo-embossing steps correspond to the steps described above, whereby they will not be repeated herein.

Figure 5:
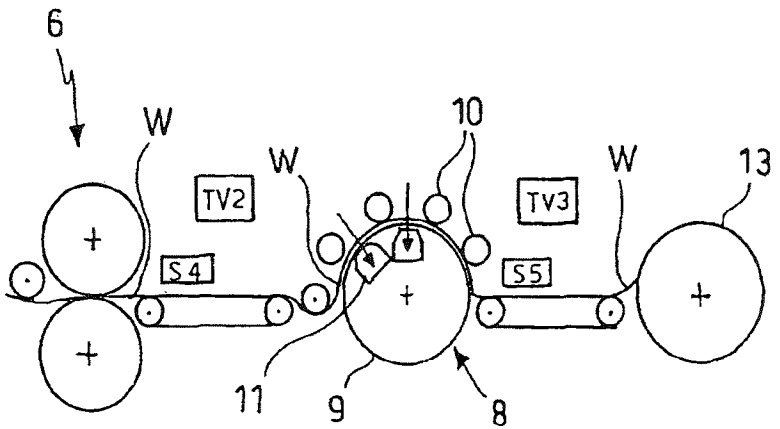
FIG. 5 is a schematic view of the manufacturing line from FIG. 1 in accordance with a fourth variant embodiment.

According to a still further object of the invention, there is provided a manufacturing plant for printed non-woven fabric comprising a printing equipment 8 and at least one hydro-embossing equipment 1, 2 (FIG. 4) or a thermo-embossing equipment 6 (FIG. 5). The respective equipments correspond to those which have already been detailed above, and may include the specified controls.

The non-woven fabric will comprise, for example, a 5% to 95% surface out of the total treated by hydro-embossing, the remaining surface, i.e. 95% to 5%, being printed by 2 to 100%. In the event that the thermo-embossing treatment and the printing treatment are employed, the non-woven fabric may comprise 2 to 30% surface treated by hydro-embossing, the remaining part being printed.

I claim:

1. A manufacturing plant for non-woven web comprising:

a treatment system including at least one hydro-embossing device and at least one thermo-embossing device, wherein the at least one hydro-embossing device is configured to apply a hydro-embossing treatment to a surface area of the non-woven web which is less than a total area of the non-woven web, and the at least one thermo-embossing device is configured to apply a thermo-embossing treatment to another surface area of the non-woven web which is less than the total surface area;

a drive system for advancing the non-woven web along said treatment system, and a control and command unit operatively connected to each of said at least one hydro-embossing device and at least one thermo-embossing device, wherein the control and command unit operates the treatment system to cause the at least one hydro-embossing device to treat a first surface area the non-woven web and the thermo-embossing device to treat a second surface area the non-woven web wherein the first portion and second surface areas do not overlap, and the first surface area is at least five percent of the total surface area of the non-woven web and the second surface area is at least two percent of the total surface area.

2. The plant according to claim 1, wherein the control and command unit includes a video camera system monitoring the non-woven web moving along the treatment system and images generated by the video camera system of the web are analyzed by the control and command unit and used to continuously monitor and adjust the advancement of the web by the drive system.

3. The plant according to claim 1, further comprising a plurality of sensors positioned along a path of the non-woven web through the treatment system, wherein the sensor are configured to detect stretching of the non-woven web and generate a stretching signal provided to the control and command unit.

4. The plant according to claim 1, further comprising an alignment device configured to align the non-woven web with a defined path through the treatment system.

5. The plant according to claim 4, wherein said alignment device comprise sensors detecting a position of the web of the non-woven web relative to the drive system.

6. The plant according to claim 1, further comprising a printer configured to print indicia on the non-woven web, wherein the printer includes a support, at least one printing member, and a holder supporting the non-woven fabric web on the support and a guide for the web.

7. A non-woven web including a first surface area treated with hydro-embossing which accounts for 5% to 95% of a total surface of the non-woven web and a remaining surface area being treated with thermo-embossing, wherein the first surface portion and the remaining surface portion do not overlap, and wherein the non-woven web is produced by:

hydro-embossing the first surface area of the non-woven web with a hydro-embossing device;

thermo-embossing the remaining surface area of the non-woven web with a thermo-embossing device.

8. The non-woven web produced according to claim 7, wherein an additional surface area treated with hydro-embossing overlaps the remaining surface area treated with thermo-embossing.

9. A process for manufacturing printed non-woven web comprising:

hydro-embossing first surface area of a sheet of the non-woven web;

thermo-embossing a second surface area of the sheet, wherein the first surface area includes areas non-overlapping with the second surface area;

after the hydro-embossing and thermo-embossing steps, printing the sheet with printing equipment including a moving printing member, wherein a driven support advances said sheet and the printing member;

performing the printing on said sheet under the control and command of a control and command unit, wherein said control and command unit is operatively connected with said support and at least one printing member such as to detect electrical signals originating from said support and at least one printing member, converting said signals into numerical values representative of an angular speed of the sheet and a speed of the printing member, comparing said numerical values with ratios of preset numerical values of said angular speeds, and sending signals to said support and printing member to correct variations of said values which fall outside said ratios.

10. An assembly for treating a non-woven web, the assembly comprising:

a treatment system including a hydro-embossing device for treating the hydro-embossing sheet and a thermo-embossing device for treating the thermo-embossing sheet wherein the hydro-embossing device is configured to apply a hydro-embossing treatment to a surface area of the non-woven web, and the thermo-embossing device is configured to apply a thermo-embossing treatment to another surface area of the non-woven web;

a drive system for advancing the sheets along said treatment system, and a control and command unit operatively connected to said hydro-embossing system and said thermo-embossing system, wherein the control and command unit is configure to cause the hydro-embossing device to apply a hydro-embossing treatment to a first surface area of the non-woven web and the thermo-embossing system to apply a thermo-embossing treatment to a second surface are of the non-woven web, wherein the second surface area is in a range of two to thirty percent of a total surface area of the non-woven web and the first surface area includes at least five percent (5%) of the total surface area and does not overlap with the second surface area.

11. A non-woven web comprising:

a first surface area of the non-woven web having hydro-embossments and is devoid of thermo-embossments, and a second surface area of the non-woven web having thermo-embossments and is devoid of hydro-embossments, wherein the second surface area is in a range of two to thirty percent of a total surface area of the non-woven web and the first surface area includes at least five percent (5%) of the total surface area and does not overlap with the second surface area.

12. The non-woven web as in claim 11 wherein the non-woven web is a fabric sheet.

13. The non-woven web as in claim 11 further comprising a third surface area of the web including hydro-embossments and thermo-embossments.

14. The non-woven web as in claim 11 wherein the first surface area covers five to ninety-five percent of a total surface area of the non-woven web.

* * * * *